US005990401A

United States Patent [19]

Braun et al.

[11] Patent Number: 5,990,401

[45] Date of Patent: Nov. 23, 1999

[54] DUAL FOOT PEDAL ASSEMBLY AND RELATED QUICK RELEASE MECHANISM

[76] Inventors: Daniel T. Braun, 547 Doat St., Buffalo, N.Y. 14211; Jon LaRue, 5597 E. Henrietta Rd., Rush, N.Y. 14543

[21] Appl. No.: 09/070,370

[22] Filed: Apr. 30, 1998

[51] Int. Cl.[6] ..... G10D 13/02; G10D 13/06

[52] U.S. Cl. ..... 84/422.1; 84/104; 84/411 R; 84/422.2; 84/DIG. 25

[58] Field of Search ..... 84/104, 111–114, 84/411 R, 422.1, 422.2, DIG. 25

[56] References Cited

U.S. PATENT DOCUMENTS

| | | | |
|---|---|---|---|
| 4,520,710 | 6/1985 | Elliott, Jr. | 84/422 R |
| 5,591,929 | 1/1997 | Wellman | 84/422.1 |
| 5,789,688 | 8/1998 | Schiano | 84/422.1 |

*Primary Examiner*—Robert E. Nappi
*Assistant Examiner*—Marlon T. Fletcher
*Attorney, Agent, or Firm*—Robert T. Braun

[57] ABSTRACT

An apparatus for use with a percussion instrument assembly includes a base unit for positioning on a preselected surface. A first instrument pedal includes a first connecting linkage having a first end and a second end. The first end of the first connecting linkage is linked to the base unit so that the first instrument pedal may be utilized to operated a first percussion instrument. A second instrument pedal is positioned adjacent the first instrument pedal. The second instrument pedal includes a second connecting linkage having a first end and a second end. The first end of the second connecting linkage is linked to the base unit so that the second instrument pedal may be utilized to operate a second percussion instrument in a manner such that the first and second pedals are capable of being alternately actuated independently and simultaneously by the foot of an operator to respectively activate one or both the first and second percussion instruments. A quick release mechanism is provided so that the first instrument pedal may be rapidly engaged and disengaged, respectively, with a third instrument pedal.

27 Claims, 12 Drawing Sheets

DUAL FOOT PEDAL ASSEMBLY AND RELATED QUICK RELEASE MECHANISM

BACKGROUND OF THE INVENTION

1. Field of the Invention

This invention relates in general to the field of musical instruments and, in particular, to percussion instruments such as drums and cymbals. More specifically, but without restriction to the particular embodiments hereinafter described in accordance with the best mode of practice, this invention relates to the instrument pedals used by musicians to operate percussion instruments.

2. Discussion of the Related Art

Music and musical instruments have been a companion part of human existence for virtually thousands of years. A parallel development in the design and manufacturing techniques for making musical instruments has accompanied the historical development of musical composition. This parallel development may generally be divided into two main functional categories including the design of new musical instruments and the redesign or improvement of known musical instruments.

For example, in regard to the design of new musical instruments, the first known harpsicord was designed and made by Gerolamo Bolognese in Rome in 1521. The popularity of this new instrument increased rapidity due to the pleasing musical tone which prior thereto had not been experienced by humankind. With the popularity of the harpsicord in Europe, national schools of construction were established principally in Italy, Flanders, France, England, and Germany. The craftsman in these national schools of construction perfected the mechanical design of the harpsicord during the 16th–18th until it became one of the most popular musical instruments in Europe. Indeed, most of the great Baroque composers played and wrote for the harpsicord. Thus, the harpsicord may be considered the musical instrument responsible for creating the Baroque genre of music.

A well known example of the redesign or improvement of a known musical instrument may be seen in the modern double-neck electric guitar. Prior thereto, two or three musicians were required to play lead, rhythm, and bass guitar. With the advent of the double-neck electric guitar, one musician could play both lead and rhythm, or rhythm and bass guitar. This design enabled the guitarist to expand the scope of his musical skills and musical repertoire.

Another important area relating to the creation of musical instruments is the craftsmanship and expert skills required for instruments made by hand. Before the advent of modern manufacturing methods, virtually all musical instruments were made by hand. Thus, metal workers became specialized and expert in hand manufacturing brass instruments such as the trumpet, French horn, and more recently, the saxiphone. Since the 16th century, guitar makers endeavered in the evolution of the acoustic guitar developing expert craftsman techniques which lead to the establishment of the "Master Lutist", who was recognized as possessing the highest level of craftsmanship and technical skills for making acoustic guitars. Similarly, the stringed instruments such as the violin, viola, cello, and bass were the object of a developing school of craftsmanship. For both the acoustic guitar and stringed instruments, wood workers developed specialized skills in making the instruments of their craft. The selection and drying of woods, along with grain patterns, bending, joining techniques, gluing, finishing, and varnishing all played an important role in producing musical instruments with improved sound quality or better tonality. For example, the family Stradivari, headed by Antonio Stradivari from the Duchy of Milan, b.1644–d.1737, is well noted for bringing violin-making to its highest level of perfection. Indeed, the Stradivarius violin to this day, commands the highest price due to the beauty of the violin's tone which resulted from the expertly optimized factors involved in its design and making.

With the advent of modern manufacturing techniques, the importance of hand-craftsmanship has been replaced by the need for precision machining and optimized mechanical design as the means for improving existing musical instruments and expanding the musical repertoire of musicians of all types. One of the most important elements of contemporary music includes percussion instruments and principally the modern drum set with related elements such as cymbal stands and base drums.

Since the first drums which included hollowed logs, many improvements in drums and other percussion instruments have been made. As time has past, music and concerts have become increasingly sophisticated. This sophistication has led musicians to require help in setting up the musician's complex instruments and stages. Thus, stage-hands or roadies need to spend hours and sometimes days working on the setup for a concert. Further, in concerts with multiple bands it is often necessary to quickly assemble and disassemble new equipment for each performing band. This is necessary because musicians rarely share equipment. Drums and percussion instruments represent one of the greatest challenges. The present invention seeks to aid the compactness, assembly, and disassembly of drums and percussion instruments. The present invention is also directed to increasing the musical repertoire of percussion musicians by allowing them to create musical beats and rhythms previously unattainable with prior art equipment.

OBJECTS AND SUMMARY OF THE INVENTION

It is, therefore, an object of the present invention to improve musical instruments.

It is furthermore an object of the present invention to provide an improved instrument pedal.

Another object of this invention is to provide a dual instrument pedal to conserve space by eliminating multiple independent pedals.

It is a further object of the present invention to provide an easily positioned pedal.

Yet still another object of the present invention is to enable a more easily attachable and detachable instrument pedal.

An additional object of the present invention is to provide a compact instrument pedal which will allow two instruments to be operated by a single foot of a musician.

Yet a further object of the present invention is to provide a compact dual foot pedal that allows the operation of a drum and a cymbal, a cymbal and a cymbal, a drum and a drum, or any combination thereof.

Yet another object of the present invention is to provide an easily packable instrument pedal.

Still yet another object of this invention is to quickly assemble and disassemble a drum set pedal assembly, so that stage equipment may be rapidly changed between performing groups.

Yet still another object of the present invention is to allow a drummer to produce a double beat on a base drum while playing a cymbal without the need for an extra foot pedal.

A further object of the present invention is to expand the musical repertoire of percussion musicians.

These and other objects are attained in accordance with the present invention wherein there is provided an apparatus including a base unit for positioning on a preselected surface, a right pedal having a first end pivotally hinged to the base unit, the right pedal linked to a first linkage for operating a first percussion instrument, and a left pedal positioned adjacent the right pedal. The left pedal is similarly provided with a first end pivotally hinged to the base unit and is linked to a second linkage for operating a second percussion instrument so that the right and left pedals are capable of being alternately actuated independently and simultaneously by the foot of an operator.

In accordance with one aspect of this invention, there is provided an apparatus for use with a percussion instrument assembly. This apparatus includes a first instrument pedal including a first connector having a first end and a second end, the first end of the first connector being linked to the first pedal; a second instrument pedal including a second connector having a first end and a second end, the first end of the second connector being linked to the second pedal; and a quick release assembly for connecting the second end of the first connector to the second end of the second connector so that the first instrument pedal may be rapidly engaged and disengaged, respectively, with the second instrument pedal.

According to another aspect of the present invention, there is further provided an apparatus for use with a percussion instrument assembly. This apparatus includes a base unit for positioning on a preselected surface, a first instrument pedal including a first connecting linkage having a first end and a second end, the first end of the first connecting linkage being linked to the base unit and the first instrument pedal utilized to operated a first percussion instrument, and a second instrument pedal positioned adjacent the first instrument pedal. The second instrument pedal includes a second connecting linkage having a first end and a second end. The first end of the second connecting linkage is linked to the base unit. The second instrument pedal is utilized to operate a second percussion instrument so that the first and second pedals are capable of being alternately actuated independently and simultaneously by the foot of an operator to respectively activate one or both the first and second percussion instruments. This embodiment of the present invention further includes a quick release assembly for connecting the second end of the first connecting linkage to the second end of the second connecting linkage so that the first instrument pedal may be rapidly engaged and disengaged, respectively, with the second instrument pedal.

The first linkage of this invention may be implemented as a chain linked to a cymbal stand for operating a pair of cymbals and the second linkage may advantageously be implemented as a connecting bar linked to a pedal assembly having a first mallet and a second mallet so that the second pedal operates the first mallet by rotating the connecting bar when the second pedal is activated. Additionally, second mallet may be linked to a third pedal attached to the pedal assembly so that the third pedal operates the second mallet. Alternatively, the first linkage may be implemented as a chain linked to a mallet for engaging a drum. This embodiment is advantageously provided with a bias linked to the first pedal for returning the first pedal to an upright position after activating the mallet.

In accordance with yet another aspect of this invention, the apparatus of the preferred embodiments may be further provided with a second base unit for positioning on a preselected surface. This second base unit is provided with a second right pedal having a first end pivotally hinged to the second base unit. The second right pedal is linked to a third linkage for operating a third percussion instrument. The second base unit also advantageously includes a second left pedal positioned adjacent the second right pedal. The second left pedal similarly includes a first end pivotally hinged to the second base unit and is linked to a fourth linkage for operating a fourth percussion instrument. The second linkage may include a rod connected to the second base unit. This embodiment may further include a third base unit wherein the fourth linkage is implemented as a second rod, the second rod being connected to the third for operating the fourth percussion instrument. The first linkage of this embodiment of the present invention may also be implemented as a chain linked to a first mallet for engaging a first drum and include a bias linked to the first pedal for returning the first pedal to an upright position after activating the mallet.

According to still yet a further aspect of this invention, the second base unit may advantageously include a second mallet so that the right pedal operates the second mallet by rotating the rod when the right pedal is activated. The second base unit may further include a third mallet and the third linkage may be a chain for operating the third mallet. In this embodiment, the fourth linkage may include a connecting bar coupled to a stand including a fourth mallet, the second right pedal thereby being enabled to move the fourth mallet when the second right pedal is activated.

In accordance with still further aspects of the present invention, the quick release assembly may advantageously include a first ball resiliently mounted on the second end of the first connector, a second ball resiliently mounted on the second end of the second connector, and a rod having a first end and a second end. The first end of the rod is provided with a first socket and the second end thereof is provided with a second socket. The first socket contains a trench for receiving the first ball and the second socket contains a trench for receiving the second ball.

Alternatively, the quick release assembly according to this invention may include a first socket mounted on the second end of the first connector, a second socket mounted on the second end of the second connector, and a rod having a first end and a second end. The first end of the rod is provided with a first ball resiliently mounted thereon and the second end provided with a second ball resiliently mounted thereon. The first socket contains a trench for receiving the first ball and the second socket contains a trench for receiving the second ball.

As yet another alternative, the quick release assembly according to the present invention may include a first post mounted on the second end of the first connector, the first post having a connecting member formed therein, a second post mounted on the second end of the second connector, the second post having a connecting member formed therein, and a rod having a first end and a second end. The first end of the rod is advantageously provided with a first receptor mounted thereon and the second end of the rod similarly provided with a second receptor mounted thereon. The first post is thereby readily engagable with the first receptor and the second post readily engagable with the second receptor. In this embodiment of the quick release assembly, the connecting members may include a dimple formed in each of the first and second posts and a corresponding locking ball assembly on each of the first and second receptors.

BRIEF DESCRIPTION OF THE DRAWING

Further objects of the present invention together with additional features contributing thereto and advantages accruing therefrom will be apparent from the following description of certain preferred embodiments of the invention which are shown in the accompanying drawing with like reference numerals indicating like components throughout, wherein.

DETAILED DESCRIPTION OF A PREFERRED EMBODIMENT

Figure 1:
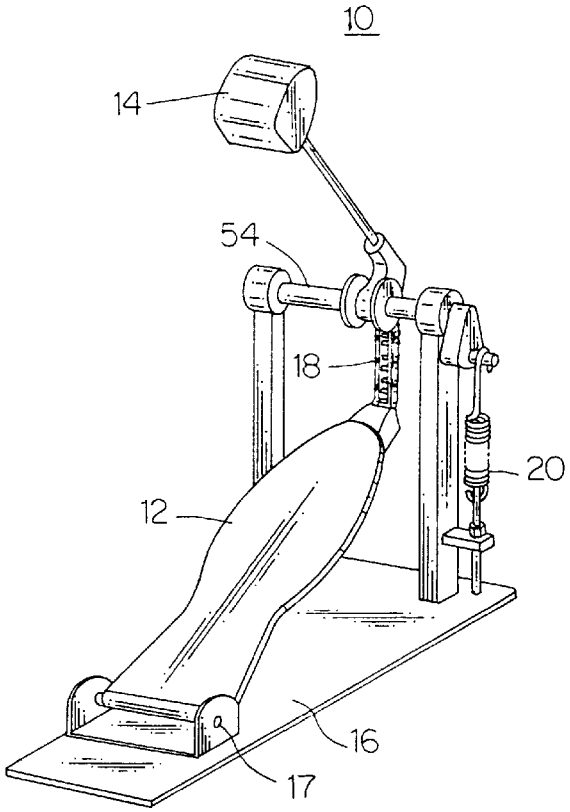
FIG. 1 Prior Art
FIG. 1 is a perspective view of a prior art drum pedal.

Referring now to FIG. 1, there is shown a foot pedal assembly 10 according to the prior art. The foot pedal assembly 10 includes a pedal 12 for operating a mallet 14 to strike a bass drum (not shown). The pedal 12 is hingably attached by hinge 17 to a base 16. A chain 18 connects mallet 14 to the pedal 12. The pedal 12 is movable between an upper position, as shown, and a lower depressed position, not shown. Depressing foot pedal 12 towards base 16 causes chain 18 to be pulled toward base 16. Pulling chain 18 towards base 16 causes mallet 14 to rotate forward to strike a bass drum. A bias spring 20 returns pedal 12 to the upper position as is known in the art.

Figure 2:
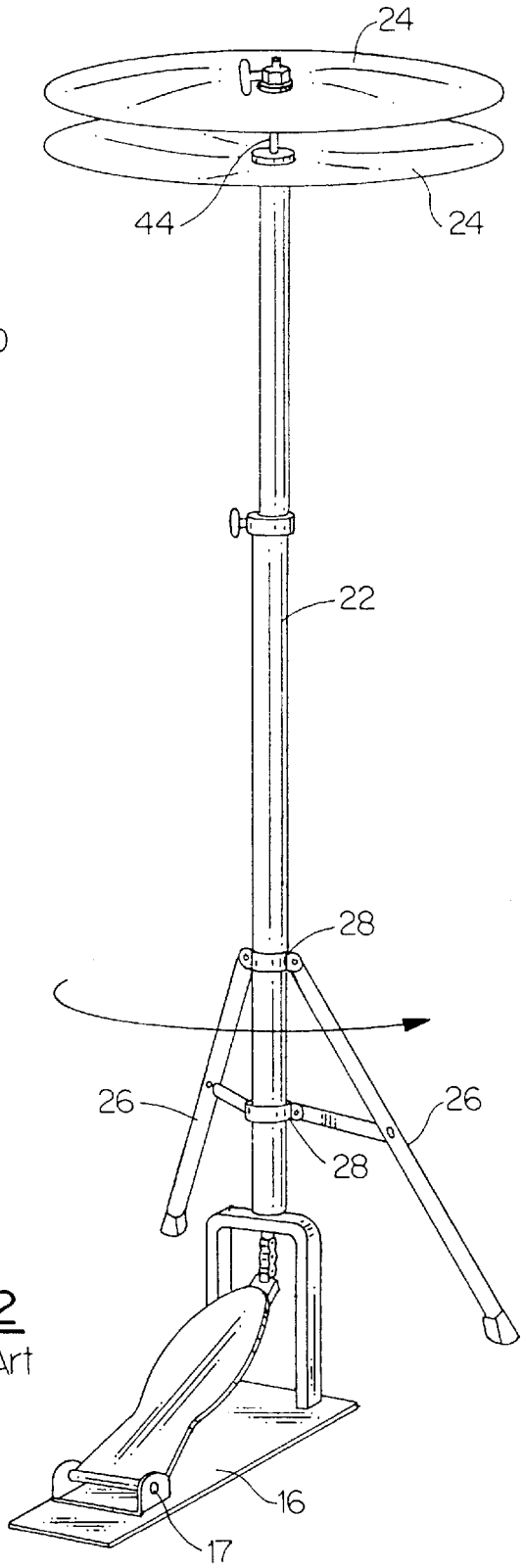
FIG. 2 Prior Art
FIG. 2 is a perspective view of the drum pedal of FIG. 1 in combination with a cymbal assembly in accordance with the prior art.

FIG. 2 shows the foot pedal assembly 10 according to the prior art for use with a cymbal stand 22 for engaging a pair of cymbals 24—24 for producing percussion music. The cymbal stand 22 includes support legs 26 which are rotatably attached by connectors 28—28 that enable support legs 26 to freely rotate about cymbal stand 22. In this manner, connectors 28—28 allow legs 26 to be rotated to a preferred position relative to the base 16 thereby allowing cymbal stand 22 to be better positioned next to other stands and/or bass drums.

Figure 3:
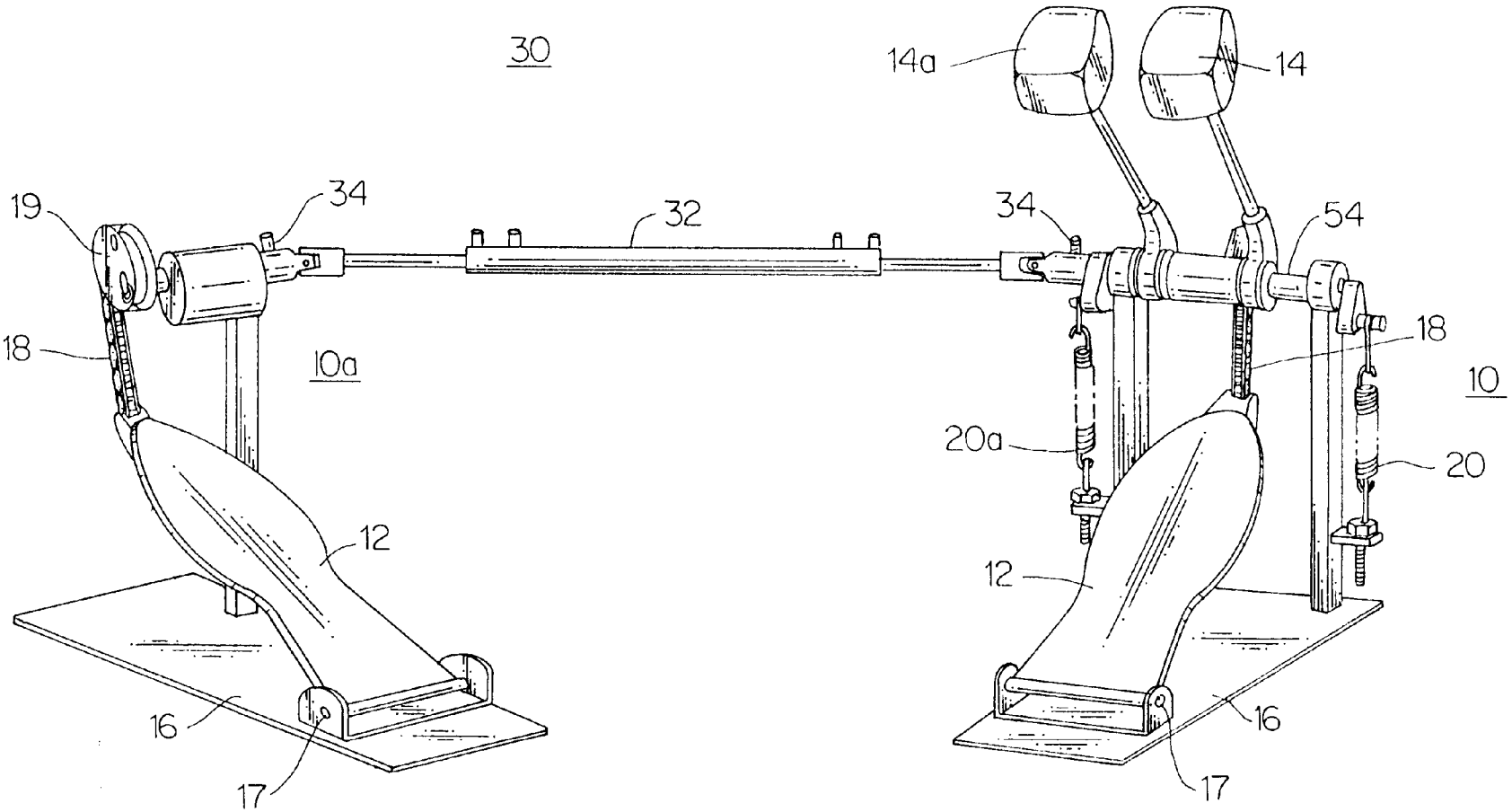
FIG. 3 Prior Art
FIG. 3 is a perspective view of a prior art double pedal assembly.

Referring now to FIG. 3, there is shown a double pedal assembly 30 according to the prior art. The double pedal assembly 30 includes the foot pedal assembly 10 and, in addition thereto, a left foot pedal assembly 10*a* connected by a connecting bar 32. Connecting bar 32 is affixed to the left foot pedal assembly 10*a* on its left end by a threaded bolt or square headed set screw 34 and affixed to foot pedal assembly 10 on its right end by another threaded bolt 34. The double pedal assembly 30 is intended for use by a right-handed drummer. As readily apparent from FIG. 3, the left foot pedal assembly 10*a* is operated by depressing the pedal 12 toward the base 16 which, in turn, pulls chain 18 which rotates a cam 19 which, in turn, rotates connecting bar 32 thereby depressing a mallet 14*a* to strike a drum positioned adjacent thereto. In the left foot pedal assembly 10*a,* pedal 12 is returned to the upright position by a bias spring 20*a*. The right foot pedal assembly 10 is operated by depressing the pedal 12 toward base 16, which pulls chain 18 as shown in FIG. 3, thereby depressing mallet 14 to strike a drum. In the right foot pedal assembly 10, pedal 12 is returned to its upright position by the bias spring 20.

Figure 4:
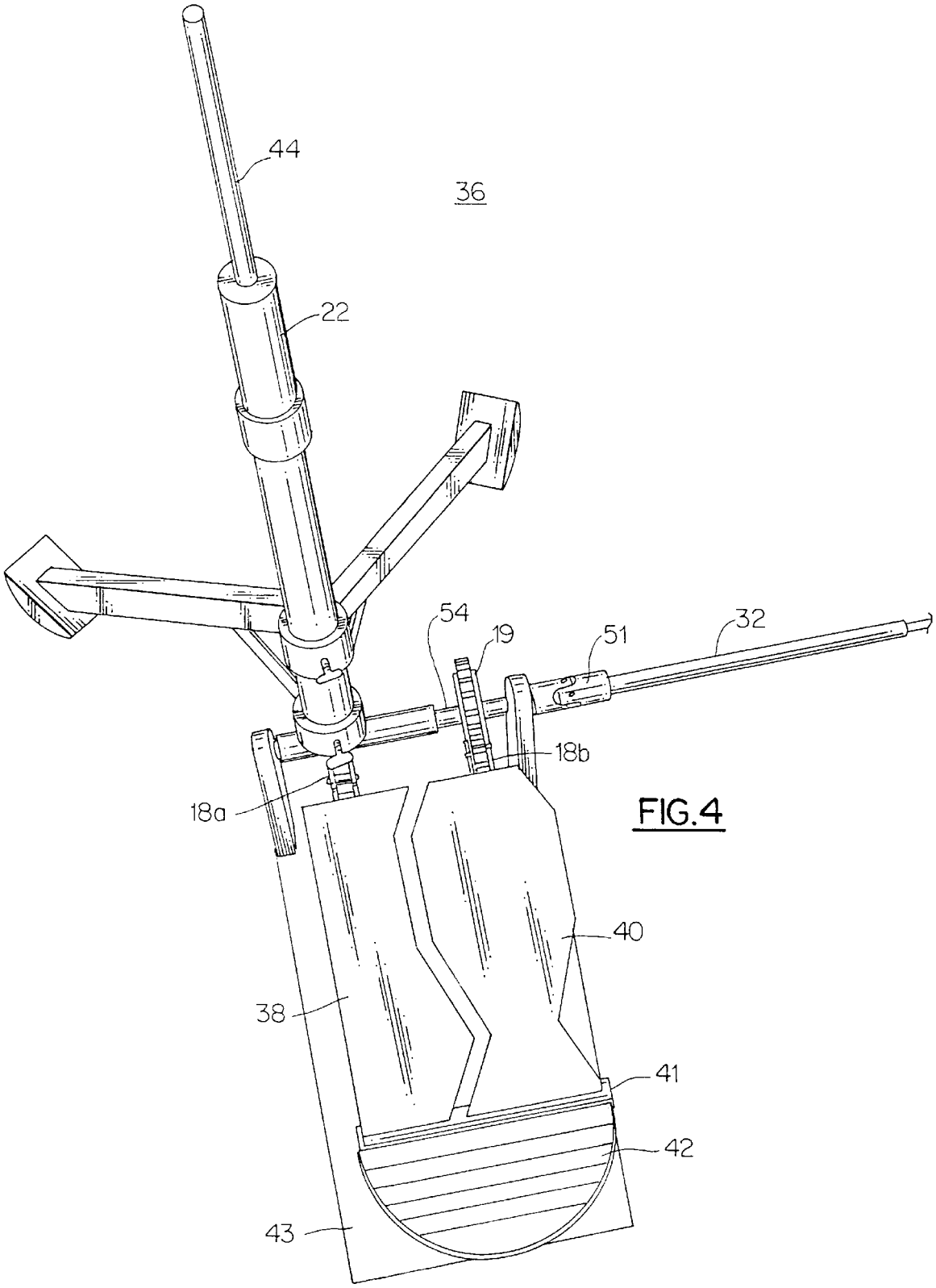
FIG. 4 shows a perspective view of a dual foot pedal assembly according to the present invention.

Turning now to FIG. 4, there is shown a dual foot pedal assembly 36 according to the present invention. Dual foot pedal assembly 36 includes a first pedal 38 attached at its lower end to a hinge 41, which in turn is attached to a dual pedal base 43 and a heel pad 42. Heel pad 42 is preferably aluminum but could be made of rubber or any other suitable material. Proximate its upper end, first pedal 38 is attached to a chain 18*a* which, in turn, is attached at its other end to a central rod 44 carried within the cymbal stand 22. Adjacent to first pedal 38 is a second pedal 40, which is attached at its lower end to hinge 41. Hinge 41, as previously noted, is affixed to the dual pedal base 43 and heel pad 42. The upper end of the second pedal 40 has a chain 18*b* affixed to its underside. Chain 18*b* is wrapped around cam 19 as shown. Cam 19 is attached to shaft 54. Shaft 54 is connected to a quick release mechanism 51 according to another aspect of the present invention. The quick release mechanism 51 is releasably attached to connecting bar 32 as explained in greater detail hereinafter.

Figure 5:
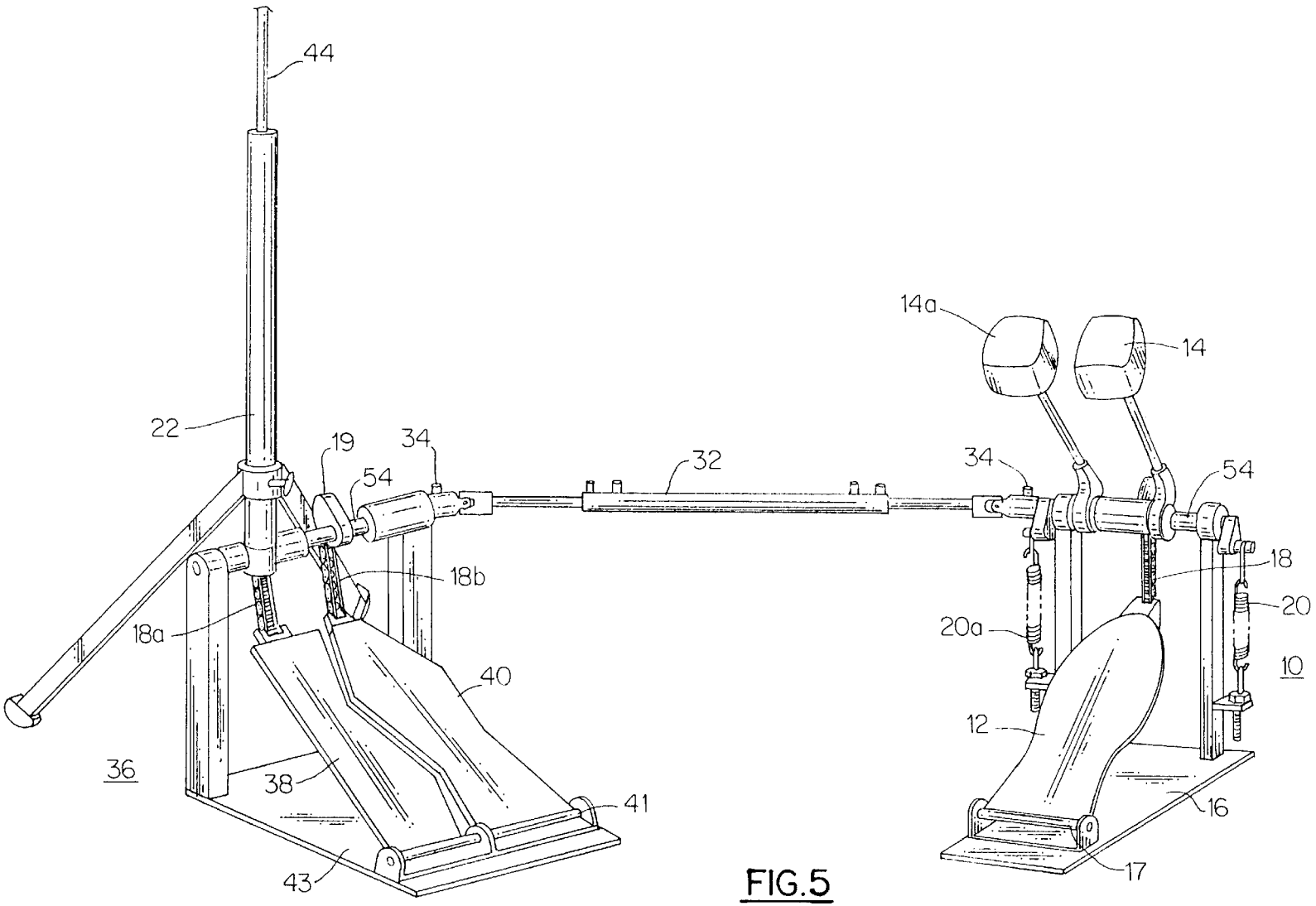
FIG. 5 is a perspective view of the present dual foot pedal assembly in combination with a foot pedal assembly including two mallets wherein the first pedal of the dual foot pedal assembly is used in combination with a cymbal stand.

Connecting bar 32 at its distant end is attached to a second foot pedal assembly, as shown in FIG. 5, which contains two mallets; the mallet nearer to dual foot pedal assembly 36 is mechanically connected by connecting bar 32 to second pedal 40. Depressing first pedal 38 toward dual pedal base 43 causes chain 18*a* to be pulled toward dual pedal base 43. This in turn causes central rod 44 of cymbal base 22 to move toward the floor. The movement of central rod 44 within cymbal base 22 causes cymbals 24—24, FIG. 2, to engage, thereby creating percussion sound. First pedal 38 may be returned to its upright position by a spring (not shown) within cymbal stand 22. Depressing second pedal 40 toward dual pedal base 43 causes chain 18*b* to be pulled toward dual pedal base 43. This in turn rotates cam 19. The rotation of cam 19 causes shaft 54 to rotate which, in turn, causes connecting bar 32 to rotate. The rotation of connecting bar 32 causes distant mallet 14*a,* FIG. 5, to strike a base drum.

With continuing reference to FIG. 5, it is shown that the dual foot pedal 36 assembly may be connected to a prior art foot pedal assembly 10. With this particular implementation of the dual pedal assembly 36, it can be seen that the first pedal 38 is connected by the hinge 41 to the dual pedal base 43 at its lower end. Near its upper end, first pedal 38 is connected by chain 18*a* to central rod 44 in cymbal stand 22. Adjacent to foot pedal 38 is second pedal 40, which is connected at its lower end to hinge 41 which, in turn, is affixed to dual pedal base 43. Near its upper end, second pedal 40 is connected by chain 18*b* to cam 19, which in turn is connected to rod 32. Rod 32 has a threaded bolt 34 for affixing connecting bar 32 to dual foot pedal assembly 36 at one end and a threaded bolt 34 to affix connecting bar 32 to foot pedal assembly 10 at its other end. FIG. 5 also shows that foot pedal assembly 10 according to the prior art has a pedal 12 connected to base 16 by a hinge 17 at its lower end. Near the upper end of pedal 12, a chain 18 is connected to a mallet 14. Here, as above, depressing foot pedal 38 toward dual pedal base 43 causes chain 18*a* to pull central rod 44, of cymbal stand 22 toward the floor. This in turn causes cymbals 24—24, FIG. 2, to engage, thereby producing music. First pedal 38 is returned to its upright position by a spring concealed within cymbal stand 22. Depressing second pedal 40 toward dual pedal base 43 causes chain 18*b* to be pulled toward dual pedal base 43. This in turn causes cam 19 to rotate. The rotation of cam 19 causes rotation of shaft 54. The rotation of shaft 54 causes the rotation of connecting bar 32. The rotation of connection bar 32 causes mallet 14*a* to rotate forward to strike a bass drum, positioned adjacent thereto. Second pedal 40 is returned to its upright position by bias spring 20*a*. Depressing pedal 12 toward base 16, causes chain 18 to be pulled toward base 16. This in turn causes mallet 14 to rotate forward and strike a base drum. Pedal 12 is returned to its upright position by bias spring 20. Foot pedal 10 operates in the manner previously described. The arrangement in FIG. 5 has the advantage that a musician can operate a cymbal and produce a double beat on a base drum without the need for a separate foot pedal. This allows the musician to create more music than is possible under the prior art systems. This arrangement has the added advantage that a musician does not have to try awkwardly jam a third pedal according to the prior art adjacent to another pedal according to the prior art for use by the drummer's left foot. A musician would need a very large foot to play a cymbal and produce a double beat on a base drum if only the prior art assemblies are utilized.

Figure 6:
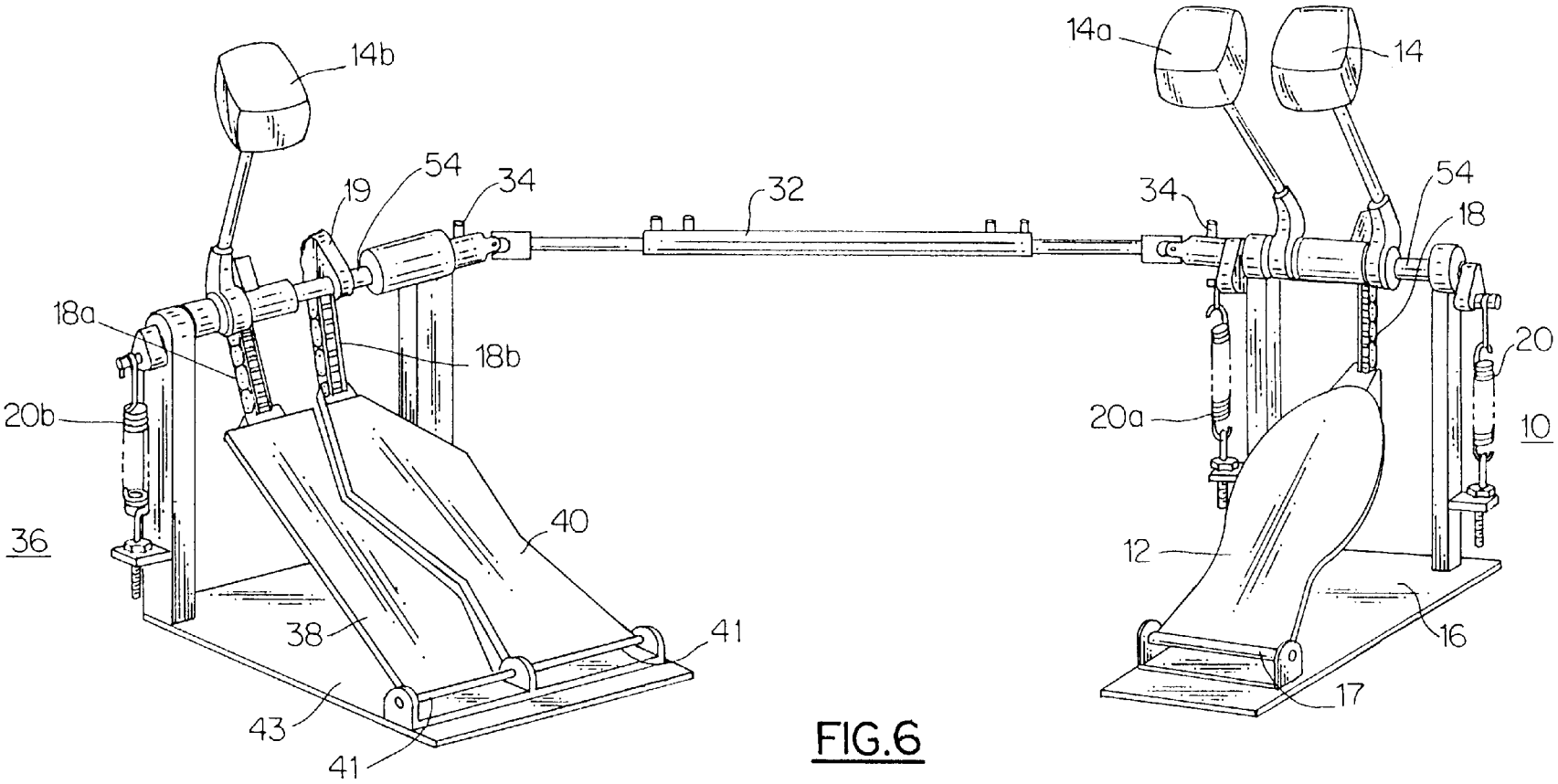
FIG. 6 is a perspective view of the dual foot pedal assembly according to the present invention, as shown in combination with a foot pedal assembly including two mallets wherein the first pedal of the dual foot pedal assembly is used in combination with a drum.

Turning now to FIG. 6, there is shown a second embodiment of the present invention. Here, as above, the dual foot pedal assembly 36 according to the present invention is connected by connecting bar 32 to the prior art foot pedal assembly 10. The first pedal 38 is hingably attached at its lower end to hinge 41 which, in turn, is affixed to dual pedal base 43. First pedal 38 has attached near its upper end the chain 18*a* for rotating the mallet 14*b* to strike a base drum. Adjacent to first pedal 38, is the second pedal 40. Second pedal 40 is attached on its lower end to hinge 41. Hinge 41 is affixed to dual pedal base 43. Second pedal 40 has attached near its upper end the chain 18*b*, which is attached to cam 19 on its other end. Cam 19 is attached to shaft 54 which in turn is connected to connecting rod 32. Connecting rod 32 is affixed on one end by a threaded bolt 34 to dual foot pedal assembly 36, and is affixed on its other end by a threaded bolt 34 to foot pedal assembly 10. Depressing first pedal 38 toward dual pedal base 43 pulls chain 18a toward dual pedal base 43. Pulling chain 18*a* toward dual pedal base 43 causes mallet 14*b* to move forward and strike a base drum. First pedal 38 is returned to the upright position shown by a bias spring 20*b*. Note bias spring 20*b* is preferably a metal spring but could be made of rubber or any other suitable material and could be formed like a band or any other suitable shape. All bias springs 20, 20*a*–20*d* could be substituted for in this manner. Depressing pedal 40 toward dual pedal base 43 pulls chain 18*b* towards dual pedal base 43. Pulling chain 18*b* toward dual pedal base 43 causes cam 19 to rotate. The rotation of cam 19 causes shaft 54 to rotate. The rotation of shaft 54 causes connecting bar 32 to rotate. The rotation of connecting bar 32 causes mallet 14*a* to move forward and strike a base drum. Foot pedal 10 operates in a manner previously described. It should be appreciated by one of skill in the art that the dual foot pedal assembly of FIG. 6, in combination with the foot pedal assembly 10 of the prior art further allows the drummer to play more drums than would be available under the prior art systems and allows for musical beats that were previously unavailable.

Figure 7:
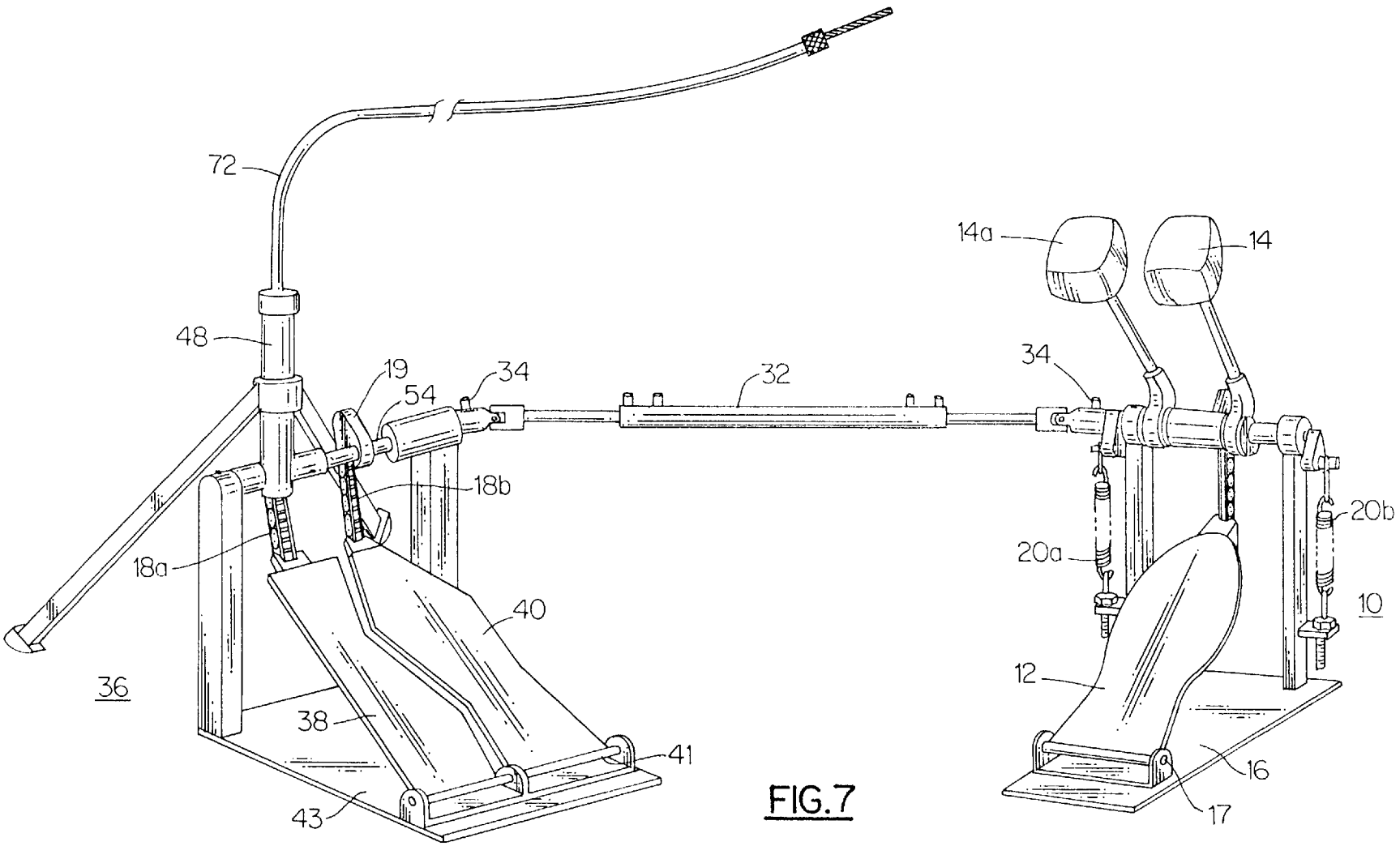
FIG. 7 is a perspective view of the present dual foot pedal assembly in combination with a foot pedal assembly including two mallets wherein the first pedal of the dual foot pedal assembly is used in combination with a remote control cable.

Turning now to FIG. 7, there is shown the dual foot pedal assembly 36 connected by connecting bar 32 to the prior art foot pedal assembly 10. In FIG. 7, first pedal 38 is connected by chain 18*a* to remote stand 48. Depressing first pedal 38 toward dual pedal base 43 causes chain 18*a* to be pulled toward dual foot pedal base 43. Pulling chain 18*a* toward dual pedal base 43 causes remote stand 48 to operate a remote cable 72, similar to a bike braking cable, to remotely engage cymbals or a mallet to strike a distantly positioned percussion instrument. The second pedal 40 adjacent to first pedal 38 is connected by chain 18*b* to the cam 19 which, in turn, is attached to shaft 54. Shaft 54 is connected to connecting bar 32 on one end and affixed in place by threaded bolt 34. The other end of connecting bar 32 is connected to foot pedal assembly 10 and affixed in place by threaded bolt 34. As above, depressing second pedal 40 toward dual pedal base 43 causes chain 18*b* to be pulled toward dual pedal base 43. This, in turn, pulls chain 18*b* toward dual pedal base 43 and causes cam 19 to rotate. The rotation of cam 19 causes the rotation of shaft 54 which, in turn, cases the rotation of connecting bar 32. The rotation of connecting bar 32 causes mallet 14*a* to move forward and strike a base drum. Pedal 40 is returned to its upright position by bias spring 20*a*. Foot pedal 10 operates in the manner previously described. The arrangement shown in FIG. 7 also allows a drummer to play more instruments than the current art allows a drummer to play. In particular, the remote stand 48 allows the musician an additional remotely operated cymbal or cymbals as attained by the use of multiple remote stands.

Figure 8:
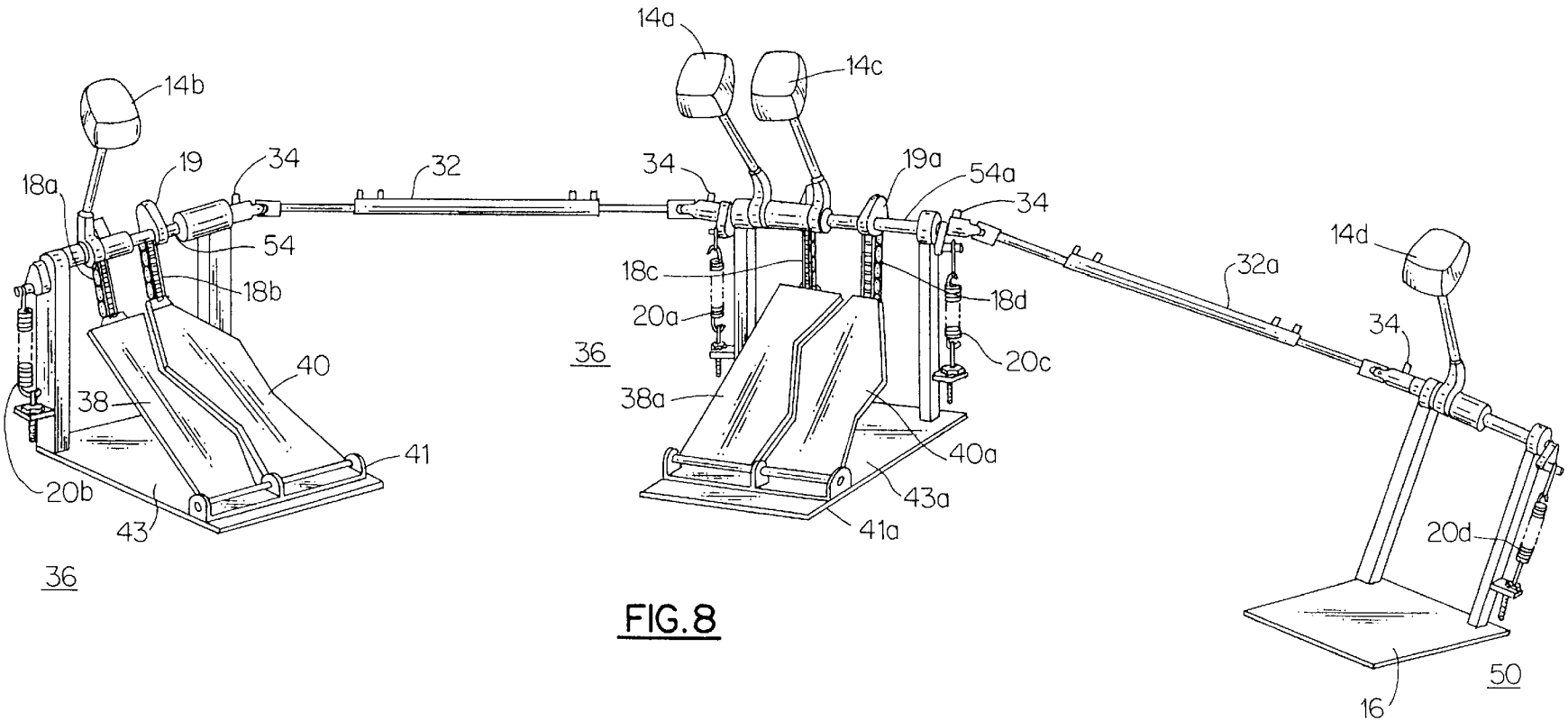
FIG. 8 is a perspective view of the present dual foot pedal assembly used in tandem and in further combination with a mallet and base assembly.

Turning to FIG. 8, there is shown two dual foot pedal assemblies 36 connected to each other according to another aspect of the present invention. These two dual foot pedal assemblies 36 are further connected to a prior art mallet stand 50. With reference to the far left dual foot pedal assembly 36, there is shown a first pedal 38 connected at its lower end to a hinge 41 which is, in turn, affixed to a dual pedal base 43. At its upper end, first pedal 38 is connected to a chain 18*a* which is, in turn, connected a mallet 14*b*. Depressing first pedal 38 toward dual pedal base 43 causes chain 18*a* to be pulled toward dual pedal base 43. Pulling chain 18*a* towards dual pedal base 43 causes mallet 14*b* to strike a base drum. First pedal 38 is returned to its upright position by bias spring 20*b*. Adjacent to first pedal 38 is second pedal 40. Second pedal 40 is attached at its lower end to hinge 41. Hinge 41 is in turn affixed to dual pedal base 43. Near its upper end, second pedal 40 has attached to its underside a chain 18*b*, which in turn is attached to a cam 19. Cam 19 is attached to shaft 54. Shaft 54 is affixed to connecting rod 32 by threaded bolt 34. Connecting rod 32 is affixed to dual foot pedal assembly 36 at shaft 54 on one end by threaded bolt 34 and is affixed on the other end to a second dual foot pedal assembly 36 at shaft 54 by a threaded bolt 34. Depressing second pedal 40 towards dual pedal base 43 causes chain 18*b* to be pulled toward dual pedal base 43. Pulling chain 18*b* toward dual pedal base 43 causes cam 19 to rotate. The rotation of cam 19 causes shaft 54 to rotate. The rotation of shaft 54 causes connecting bar 32 to rotate. The rotation of connecting bar 32 causes mallet 14*a* to move forward to strike a base drum. Second pedal 40 is returned to its up right position by bias spring 20*a*.

With reference now to the second or right dual pedal assembly 36 of FIG. 8, there is shown a first pedal 38*a* connected on its lower end, to a hinge 41*a*. Hinge 41*a* is in turn affixed to dual pedal base 43*a*. At its upper end, first pedal 38*a* is connected by a chain 18*c* to a mallet 14*c*. Depressing first pedal 38*a* toward dual pedal base towards 43*a* causes chain 18*c* to be pulled towards dual pedal base 43*a*. Pulling chain 18*c* towards dual pedal base 43*a* causes mallet 14*c* to move forward to strike a base drum not shown. First pedal 38*a* is returned to its upright position by biased spring 20*c*. Adjacent to first pedal 38*a* is a second pedal 40*a*. Second pedal 40*a* is attached near its lower end to a hinge 41*a*. Hinge 41*a* is in turn affixed to dual pedal base 43*a*. Second pedal 40*a* has attached near its upper end on its under side a chain 18*d*. Chain 18*d* is attached at its other end to a cam 19*a*. Cam 19*a* is in turn attached to shaft 54*a*. Shaft 54*a* is in turn connected to connecting bar 32*a*. Connecting bar 32*a* is affixed to the second dual foot pedal assembly 36 by threaded bolt 34. On its other end, connecting bar 32*a* is affixed to mallet stand 50 by a threaded bolt 34, as shown. Depressing second pedal 40*a* toward dual pedal 43*a* causes chain 18*d* to be pulled toward dual pedal 43*a*. Pulling chain 18*d* toward dual pedal base 43*a* causes cam 19*a* to rotate. The rotation of cam 19*a* causes shaft 54*a* to rotate. The rotation of shaft 54*a* causes connecting bar 32*a* to rotate. The rotation of connecting bar 32*a* cause mallet 14*d* to move forward to strike a base drum. Second pedal 40*a* is returned to its up right position by bias spring 20*d*.

It will be readily apparent to one of skill in the art that the assembly of FIG. 8 allows a musician to operate many more percussion instruments using the dual foot pedal assembly 36 according to the present invention. It should be appreciated that any of the mallets 14*a*, 14*b*, 14*c* or 14*d* could be interchanged with a cymbal stand 22 or a remote stand 48 thereby allowing a mix of drums and cymbals to operated by the dual foot pedal assembly 36 according to the present invention. The dual foot pedal assembly according to the present invention allows a musician to utilize far more percussion instruments than were available with the prior art assemblies. The present invention allows a musician to create more beats and more rhythms than were previously available.

Figure 9:
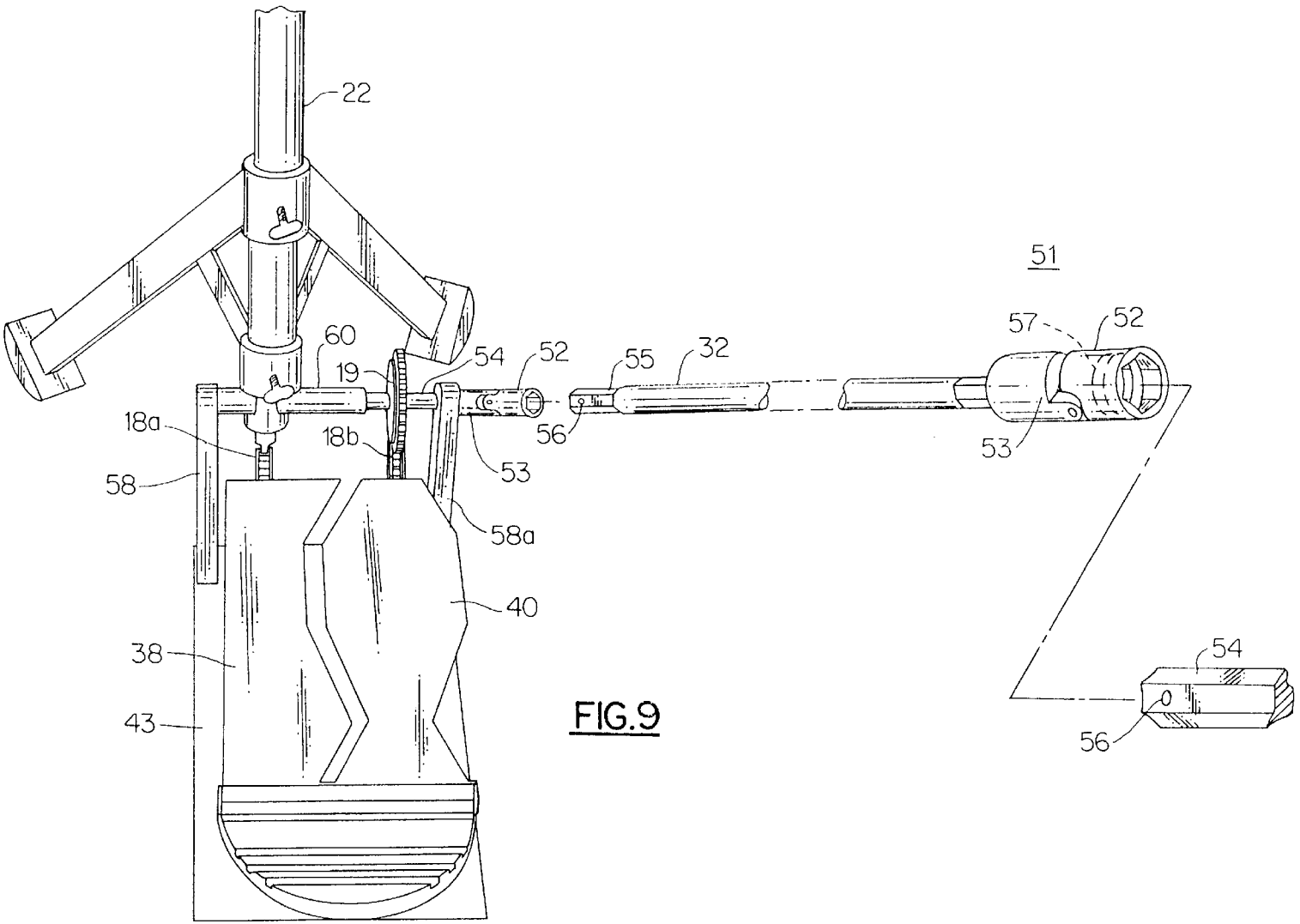
FIG. 9 is a partially exploded perspective view of the present dual foot pedal assembly showing a quick-release connecting bar in accordance with one preferred embodiment of the present invention.

With reference now to FIG. 9, there is shown a dual foot pedal assembly 36 according to the present invention highlighting an additional aspect of the present invention. This aspect of the present invention is a quick release mechanism 51.

As shown in FIG. 9, the dual foot pedal assembly 36 has a dual pedal base 43. Dual pedal base 43 contains a support leg 58 and a support leg 58*a* near its upper edge. Support leg 58 contains a hollow support tunnel 60 which extends horizontally from its upper surface. Hollow support tunnel 60 has a shaft 54 extending through cam 19 and support leg 58*a*. The end of shaft 54 near support leg 58*a* contains a ball 56 or balls 56 resiliently positioned a few centimeters from the end of shaft 54, connecting bar 32 is modified on both ends to contain a universal joint 53. Universal joint 53 has a quick release socket 52 on its far end. Quick release socket 52 contains a trench 57 for receiving ball 56. Quick release socket 52 fits over the end of shaft 54 and is locked in place by ball 56 being received in trench 57. An alternative embodiment also shown in FIG. 9 includes placement of connecting bar shaft 55 on connecting bar 32 and universal joint 53 having a quick release socket 52 with trench 57 fixedly attached to shaft 54 near support leg 58*a* on dual foot pedal assembly 36.

Figure 10:
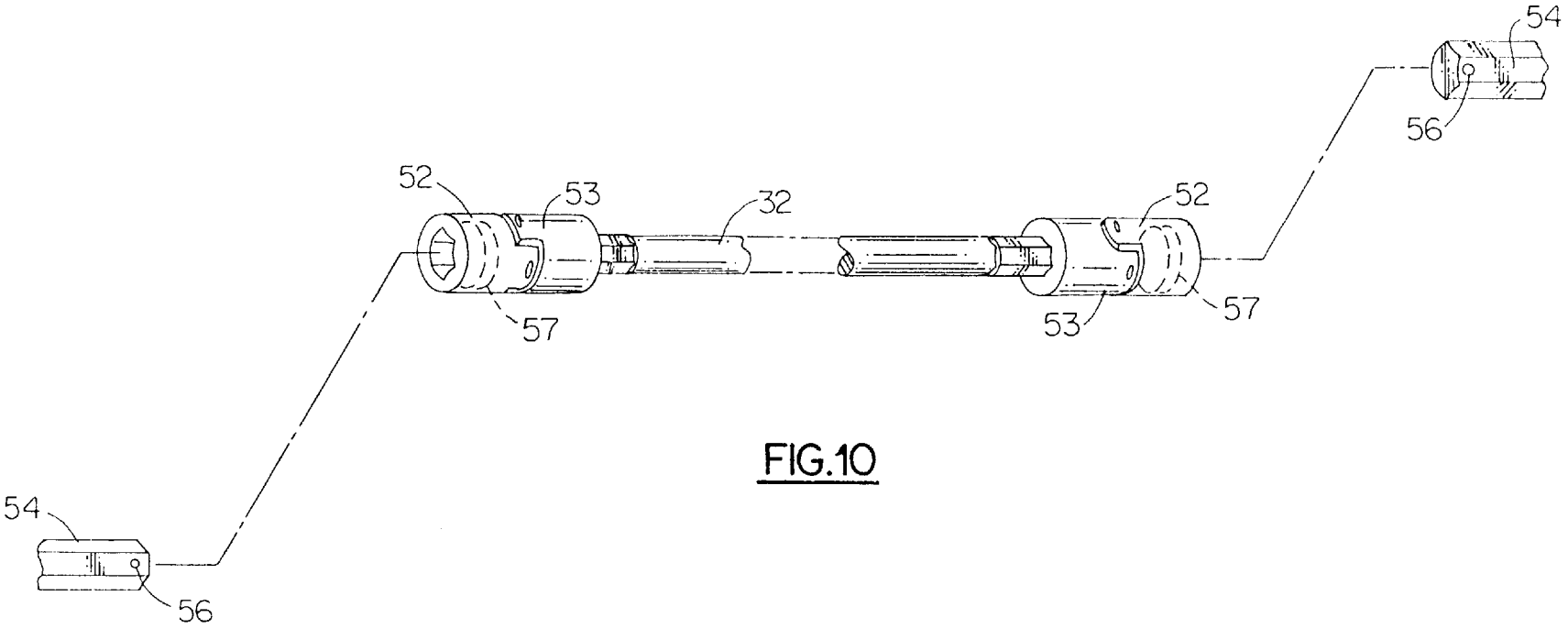
FIG. 10 is an isolated perspective view of the connecting bar and quick release mechanisms shown in FIG. 9.

In the embodiment shown in FIG. 10, universal joint 53 is affixed to both ends of connecting bar 32. To operate quick release mechanism 51, quick release socket 52 containing trench 57 is pushed onto shaft 54 and locked into place when ball 56 on shaft 54 of dual foot pedal assembly 36, of foot pedal assembly 10, or of double pedal assembly 30, is received by trench 57 of quick release socket 52. Note the prior art foot pedal assembly 10 and double foot pedal assembly 30 would have to be modified from the prior art affixed threaded bolt 34 system to the present invention quick release mechanism 51 including the quick release socket 52 having trench 57 and resiliently mounted ball 56 or balls 56 in shaft 54 or by placing or affixing a quick release mechanism 51 including the quick release socket 52 having trench 57 on shaft 54 of foot pedal assembly 10 and both shafts 54 of double pedal assembly 30 and modifying the ends of connecting bar 32 to contain a resiliently mounted ball 56 or balls 56.

With reference again to FIG. 9, when second pedal 40 is depressed toward dual pedal base 43, chain 18*b* is pulled toward dual pedal base 43, pulling chain 18*b* toward dual pedal base 43 which causes cam 19 to rotate. The rotation of cam 19 causes shaft 54 which extends through cam 19 to rotate. In turn, the rotation of shaft 54 causes quick release socket 52 and universal joint 53 to rotate. The rotation of universal joint 53 causes connecting bar 32 to rotate also. As readily apparent, the removal of the threaded bolt from the present invention allows the user to quickly connect and disconnect connecting bar 32 from the dual foot pedal assembly 36, the modified prior art foot pedal assembly 10 or the modified dual pedal assembly 30 thereby allowing easier assembly and disassembly of percussion drum sets.

Figure 11B:
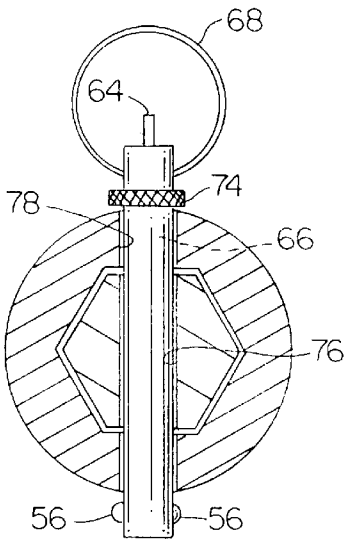
FIGS. 11A–11C illustrate in various views of a second embodiment of a quick release mechanism utilized to connect the connecting bar with a connecting shaft in accordance with the present invention.
Figure 11A:
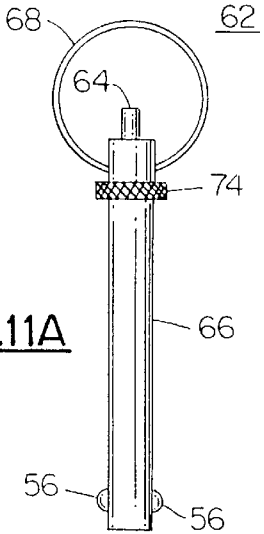
Figure 11C:
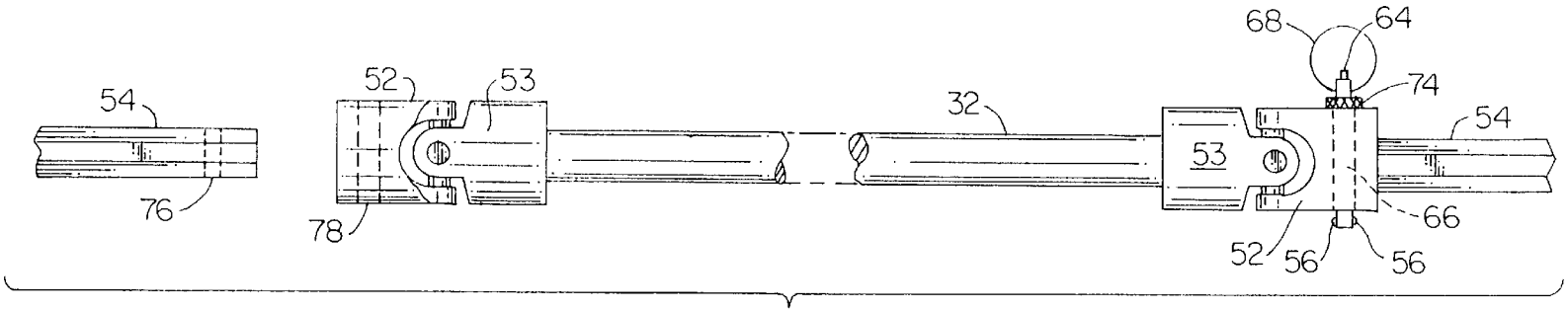

With reference now to FIGS. 11A–11C, another embodiment for the quick release feature is implemented as a quick release pin 62. Quick release pin 62 takes the place of threaded bolt 34. Quick release pin 62 contains a button 64, which is positioned on a hollow shaft 66 and contains two balls 56—56 near its bottom end. Hollow shaft 66 contains enough space to allow balls 56—56 to enter hollow shaft 66 when button 64 is depressed. Releasing button 64 cause balls 56—56 to lock outside hollow shaft 66 as shown in FIG. 11A. Depressing button 64 allows quick release pin 62 to be inserted and retracted from quick release socket 52 of universal joint 53. Near the top of quick release pin 62 the hollow shaft 66 also has a ring 68 connected to it. Quick release pin 62 is inserted through universal joint 53 at quick release socket 52 by inserting quick release pin 62 into socket bore 78 then through shaft bore 76 in shaft 54 and back through socket bore 78 in quick release socket 52. Balls 56 lock the quick release pin 62 in place. This embodiment has the advantage that connecting bar 32 is rigidly connected to shaft 54, thereby keeping the vibration to a minimum when shaft 54 and connecting bar 32 rotate. Depressing button 64 of quick release pin 62 causes balls 56—56 to retract into hollow shaft 66 thereby unlocking quick release pin 62. The user can then insert a finger through ring 68 and quickly pull quick release pin 62 from shaft 54 and quick release socket 52 of universal joint 53. This aspect of the present invention has the advantage that a musician can quickly assemble and disassemble the system without having to rely on tools to remove the prior art bolts 34.

Figure 12:
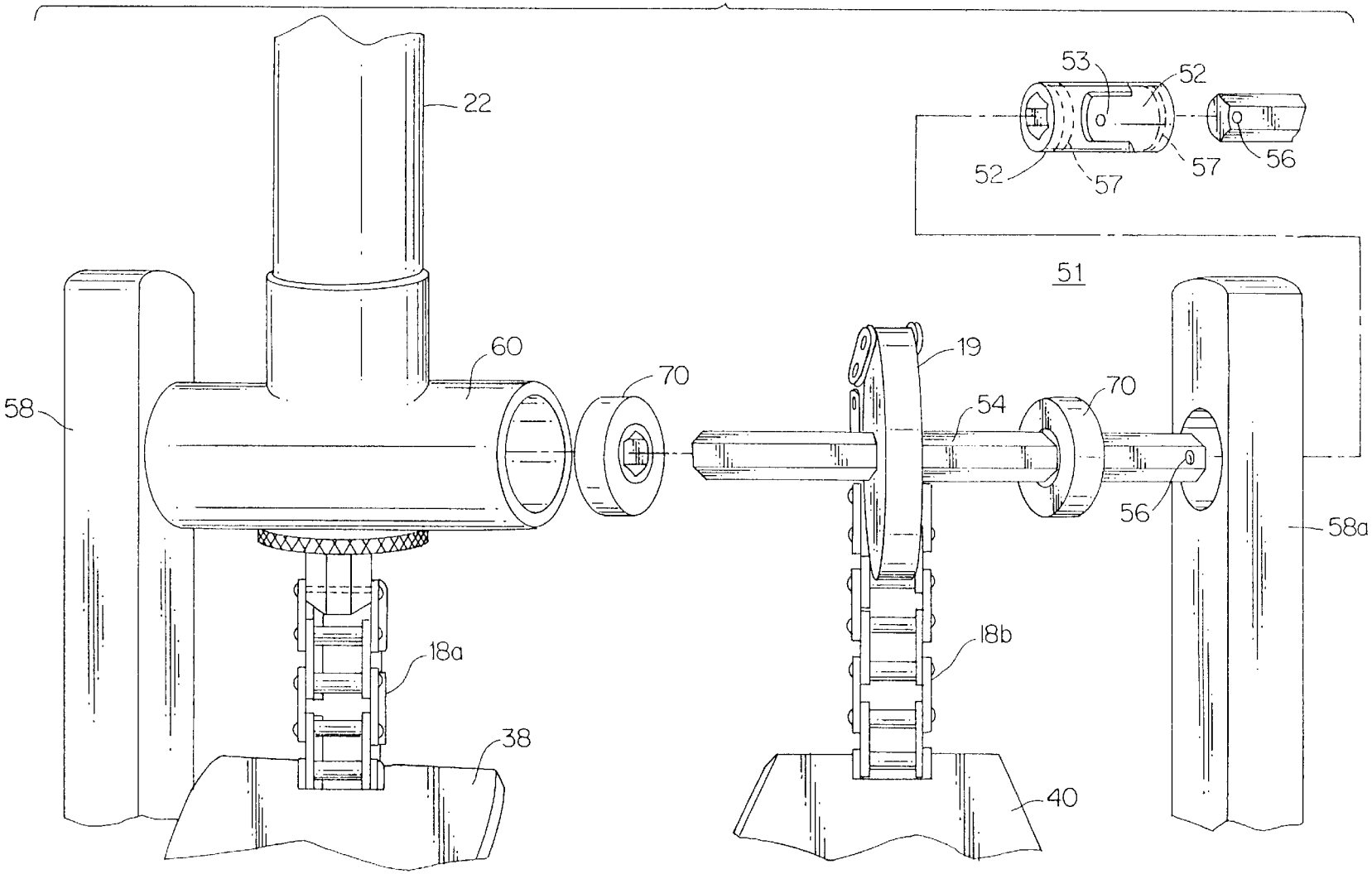
FIG. 12 is a detailed exploded view of the upper portion of the dual foot pedal assembly according to the present invention showing a third embodiment of the quick release mechanism according to the present invention.

Turning now to FIG. 12 with reference to previously described FIG. 9, there is shown an exploded view of quick release mechanism 51 and the upper portion of dual pedal assembly 36 according to the present invention. As shown, support leg 58 holds hollow support tunnel 60 within which resides a bearing 70. Shaft 54 is placed within bearing 70 and extends through cam 19. Shaft 54 then extends through a second bearing 70 contained within support leg 58*a*. Ball 56 is resiliently positioned near the end of shaft 54 which protrudes from support leg 58*a* through bearing 70. Universal joint 53 including quick release socket 52 having interior trench 57 is placed on connecting bar 32. Connecting bar 32 can then be fitted over shaft 54 and locked in place when ball 56 is received by trench 57 of quick release socket 52. When the second pedal 40 is depressed toward dual pedal base 43, FIG. 9, chain 18*b* is pulled toward dual pedal base 43. Pulling chain 18*b* toward the dual pedal base 43 causes cam 19 to rotate. Rotation of cam 19 causes shaft 54 to rotate on bearing 70 within hollow support tunnel 60 and support leg 58*a*. Ball 56 which, when in operation is engaged by trench 57 within quick release socket 52 of universal joint 53, causes connecting bar 32, FIG. 9, to also rotate. The user can disconnect connecting bar 32 from dual pedal assembly 36 by applying enough force to dislodge ball 56 from trench 57 of quick release socket 52. The above-described quick release system is reversible by placing the quick release mechanism 51 having the universal joint 53 including a quick release socket 52 having a trench 57 mounted on shaft 54 of dual pedal assembly 36. A modified connecting bar 32 having a ball 56 resiliently mounted on each end can be fitted into quick release socket 52 and locked in place when ball 56 is received by trench 57. Alternatively, quick release mechanism 51 could have a modified universal joint 53. Universal joint 53 would be modified such that both ends of universal joint 53 include a quick release socket 52. Both ends of connecting bar 32 would be modified to contain a ball 56 or balls 56 resiliently mounted a few centimeters from each end. To operate the quick release mechanism 51, the quick release socket 52 on one end of universal joint 53 would be fitted over shaft 54 and locked in place when the ball 56 on shaft 54 is received by trench 57. The quick release socket 52 on the other end of universal joint 53 would be fitted over the end of connecting bar 32 and locked in place when the ball 56 on connecting bar 32 is received by trench 57. The described systems have the advantage that it allows a musician to quickly assemble and disassemble connecting bar 32 from a dual foot pedal assembly 36 according to the present invention, a modified foot pedal assembly 10 according to the prior art, or a modified double pedal assembly 30 according to the prior art, in a very rapid manner. As before, the prior art foot pedal assembly 10 and double pedal assembly 30 can be modified by resiliently mounting a ball 56 or balls 56 on shaft 54 or mounting a quick release mechanism 51 on shaft 54 of foot pedal assembly 10 or on the respective shaft 54 of each pedal base of double pedal assembly 30. This has the further advantage of requiring no tools to connect or disconnect connecting bar 32 to dual foot pedal 36, and/or another dual foot pedal assembly 36, or a modified foot pedal assembly 10.

Figure 13B:
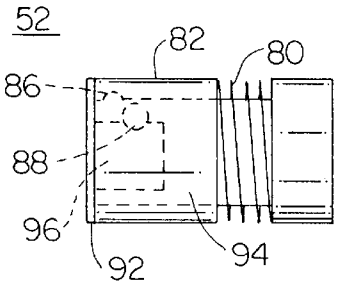
FIGS. 13A–13C show different views of a fourth embodiment of a quick release mechanism utilized to connect the connecting bar with a connecting shaft in accordance with the present invention.
Figure 13C:
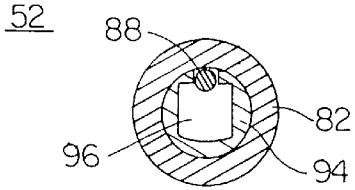
Figure 13A:
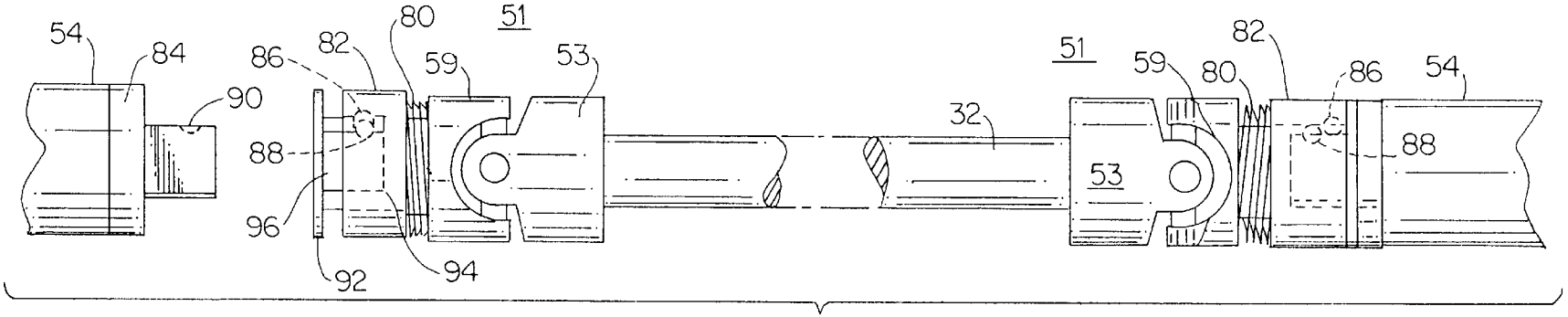

Turning now to FIGS. 13A—13C, there is shown another preferred embodiment of the quick release mechanism 51 according to the present invention. FIG. 13A shows a connecting bar 32 having an universal joint 53 including a quick release base 59 attached to each end of connecting bar 32. On the left end of connecting bar 32, there is shown the quick release mechanism 51 in the disengaged position and on the right end of connecting bar 32 there is shown the quick release mechanism 51 according to the present invention in the engaged position. FIG. 13B shows the quick release mechanism 51 in greater detail. The main body of quick release mechanism 51 is formed by a receptor 94 and base 59. About the body of receptor 94, a spring 80 is positioned having one end abutting base 59 and having its other end abutting a sleeve 82. Sleeve 82 is likewise positioned around the core of receptor 94. Sleeve 82 further contains a sleeve trench 86 for receiving locking ball 88 when sleeve 82 is retracted onto spring 80. Spring 80 forces sleeve 82 against a lip 92 at the open end of receptor 94. Receptor 94 further contains a receptor bore 96 for receiving a T-end or post 84 formed on shaft 54. The quick release mechanism 51 shown in FIG. 13B is pictured in the engaged position. As can be seen, spring 80 forces sleeve 82 against lip 92 of receptor 94. Forcing sleeve 82 against lip 92 of receptor 94 forces locking ball 88 out of sleeve trench 86 and into T-end trench or dimple 90 of T-end 84 on shaft 54, FIG. 13A. In this regard, the locking ball 88 firmly holds shaft 54 into the receptor bore 96 of quick release mechanism 51. To disengage quick release mechanism 51 from Tend 84 of shaft 54, the user pulls sleeve 82 back toward universal joint 53 thereby compressing spring 80. Locking ball 88 then is able to move from the position shown in FIG. 13B into sleeve trench 86 thereby allowing the user to remove quick release mechanism 51 from the T-end 84 of shaft 54. As quick release mechanism 51 is moved off of the T-end 84 of shaft 54, locking ball 88 is able to move out of T-end trench 90 and up into sleeve trench 86. To lock quick release mechanism 51 onto the T-end 84 of shaft 54, the user slides sleeve 82 back onto spring 80 thereby compressing it. Locking ball 88 is then able to move freely into sleeve trench 86. The quick release mechanism 51 is then pushed over T-end 84 of shaft 54 by use of receptor bore 96. The user then releases sleeve 82 causing spring 80 to push sleeve 82 forward against lip 92 forcing locking ball 88 down into T-end trench 90 thereby firmly locking the quick release mechanism 51 and thereby connecting bar 32 firmly onto shaft 54.

A further detail of this embodiment of the present invention can be seen in FIG. 13C. In FIG. 13C a cross section of the inside of receptor 94 and a sleeve 82 is shown. In this cross section of receptor 94 and sleeve 82, there can be seen the sleeve 82 surrounding a receptor 94 which defines a receptor bore 96 and shows locking ball 88 in the engaged position protruding into receptor bore 96. When engaged as shown, locking ball 88 is forced into T-end trench 90 of T-end 84 of shaft 54. It should be readily apparent from the above that a user can quickly connect and disconnect a dual pedal assembly 36, a modified foot pedal assembly 10, or a modified double pedal assembly 30 by merely sliding sleeve 82 back and forth. This system has the advantage that tools are not necessary for the assembly and disassembly of foot pedal assemblies to each other.

It should be noted that the system as described above is for a right-handed drummer. For a left-handed drummer, the system previously described would be reversed in a manner that would be known to one of skill in the art. Since the quick-release mechanism do not have a left- or right-hand orientation, there would be the same in either a right-handed or left-handed set. The above quick-release system has the advantage that no tools are necessary to assemble the foot pedal assemblies. The system has the other advantage that it allows much quicker assembly and disassembly of foot pedals for percussion instruments.

While this invention has been described in detail with reference to certain preferred embodiments, it should be appreciated that the present invention is not limited to those precise embodiments. Rather, in view of the present disclosure which describes the current best mode for practicing the invention, many modifications and variations would present themselves to those of skill in the art without departing from the scope and spirit of this invention. For example, the quick release aspect of this invention could be implemented by placing a threaded connector on either connecting bar 32 in place of the quick release socket 52 of universal joint 53 or shaft 54 and a threaded sleeve of the connecting bar 32 or shaft 54 not selected for the threaded connector. The threaded sleeve would be moved forward to be engaged with the threaded connector and screwed down to hand tightness thereby firmly connecting the connecting bar 32 to shaft 54. Another example of a way the quick release mechanism of the present invention could be implemented is by having a male plug and a female socket on connecting bar 32 and shaft 54 respectively or visa versa. The male plug and female socket may be further secured together by having a strap or straps binding the male plug to the female socket. The strap or straps may be permanently affixed to either the male plug or female socket and removably connected to the other. Alternatively, the outer surface of the male plug and female socket may have hooks or fasteners (velcro) mounted thereon and the straps would be made of the reverse (hooks or fasteners). Alternatively, the male plug and female socket, once engaged, could be twisted into a locked position thereby firmly engaging and connecting bar 32 to shaft 54. A further example of an implementation of the quick release mechanism aspect of this invention is a coupling similar to a gas coupling used in outdoor barbeques.

Thus, the scope of the invention is indicated by the following claims rather than by the foregoing description. All changes, modifications, and variations coming within the meaning and range of equivalency of the claims are to be considered within their scope.

What is claimed is:

1. An apparatus for use with a percussion instrument assembly, said apparatus comprising:

a first instrument pedal assembly including a first connector having a first end and a second end, said first end of said first connector being linked to said first pedal assembly;

a second instrument pedal assembly including a second connector having a first end and a second end, said first end of said second connector being linked to said second pedal assembly: and a quick release assembly for connecting said second end of said first connector to said second end of said second connector so that said first instrument pedal assembly may be rapidly engaged and disengaged, respectively, with said second instrument pedal assembly.

2. The apparatus according to claim 1 wherein said quick release assembly includes:

a first ball resiliently mounted on said second end of said first connector;

a second ball resiliently mounted on said second end of said second connector; and a rod having a first end and a second end, said first end having a first socket and said second end having a second socket, said first socket containing a trench for receiving said first ball and said second socket containing a trench for receiving said second ball.

3. The apparatus according to claim 1 wherein said quick release assembly includes:

a first socket mounted on said second end of said first connector;

a second socket mounted on said second end of said second connector; and a rod having a first end and a second end, said first end having a first ball resiliently mounted thereon and said second end having a second ball resiliently mounted thereon, said first socket containing a trench for receiving said first ball and said second socket containing a trench for receiving said second ball.

4. The apparatus according to claim 1 wherein said quick release assembly includes:

a first post mounted on said second end of said first connector, said first post having connecting means formed therein;

a second post mounted on said second end of said second connector, said second post having connecting means formed therein; and a rod having a first end and a second end, said first end having a first receptor mounted thereon and said second end having a second receptor mounted thereon, said first post being readily engaged with said first receptor and said second post being readily engaged with said second receptor.

5. The apparatus according to claim 4 wherein said connecting means includes a dimple formed in each of said first and second posts and a corresponding locking ball assembly on each of said first and second receptors.

6. The apparatus according to claim 5, wherein each of said posts is shaped to prevent misalignment of said dimple with said locking ball assembly when said posts are engaged with said receptors.

7. The apparatus according to claim 4, wherein each of said posts is asymmetrically shaped.

8. The apparatus according to claim 1, wherein said quick release assembly includes a pin, and wherein:

said second end of said first connector contains a first bore adapted to receive said pin; and said second end of said second connect or contains a second bore for receiving said pin when said second bore is aligned with said first bore.

9. The apparatus according to claim 8, wherein said quick release assembly further includes a locking mechanism for releasably securing said pin within said first bore and said second bore.

10. The apparatus according to claim 9 wherein said locking mechanism includes at least one resiliently mounted ball.

11. The apparatus according to claim 10 wherein said locking mechanism further includes a button for releasing said ball to allow said pin to be easily engaged and disengaged with said first bore and said second bore.

12. The apparatus according to claim 1, wherein said second end of said first connector contains a first bore, and wherein said quick release assembly includes:

a rod having a first end and a second end, said first end of said rod connecting to said second end of said first connector, said second end of said rod connecting to said second end of said second connector, said first end of said rod containing a second bore; and a pin for engaging said first bore and said second bore when said first bore and said second bore are aligned.

13. The apparatus according to claim 12, wherein said quick release assembly further includes a locking mechanism for releasably securing said pin within said first bore and said second bore.

14. The apparatus according to claim 2 wherein said quick release assembly includes:

a first thread formed on said second end of said first connector;

a second thread formed on said second end of said second connector;

a rod having a first end and a second end, said first end having a first rotatably mounted threaded sleeve and said second end having a second rotatably mounted threaded sleeve said first threaded sleeve being readily engaged with said first thread and said second threaded sleeve being readily engaged with said second thread.

15. The apparatus according to claim 1 wherein said quick release assembly includes:

a first plug formed on said second end of said first connector;

a second plug formed on said second end of said second connector;

a rod having a first end and a second end, said first end of said rod having a first receptor and said second end of said rod having a second receptor, said first plug releasably engaging with said first receptor and said second plug releasably engaging with said second receptor.

16. The apparatus according to claim 15 further including:

a first strap for releasably securing said first plug to said first receptor; and a second strap for releasably securing said second plug to said second receptor.

17. The apparatus according to claim 16 wherein:

said first strap is fixed to said first plug; and said second strap is fixed to said second plug.

18. The apparatus according to claim 16 wherein:

said first strap is fixed to said first receptor; and said second strap is fixed to said second receptor.

19. The apparatus according to claim 15 further including:

a releasable locking mechanism for maintaining contact between said first plug and said first receptor and between said second plug and said second receptor when said first plug is engaged with said first receptor and said second plug is engaged with said second receptor.

20. An apparatus for use with a percussion instrument assembly, said apparatus comprising:

a base unit for positioning on a preselected surface;

a first instrument pedal including a first connecting linkage having a first end and a second end, said first end of said first connecting linkage being linked to said base unit, said first instrument pedal utilized to operated a first percussion instrument;

a second instrument pedal positioned adjacent said first instrument pedal, said second instrument pedal including a second connecting linkage having a first end and a second end, said first end of said second connecting linkage being linked to said base unit, said second instrument pedal utilized to operate a second percussion instrument so that said first and second pedals are capable of being alternately actuated independently and simultaneously by the foot of an operator to respectively activate one or both said first and second percussion instruments; and a quick release assembly for connecting said second end of said first connecting linkage to said second end of said second connecting linkage so that said first instrument pedal may be rapidly engaged and disengaged, respectively, with said second instrument pedal.

21. An apparatus for use with percussion assembly comprising:

a first mallet;

a first pedal linked to said first mallet for engaging said first mallet with a drum;

a second pedal for operating a pair of cymbals;

a second mallet;

a connecting bar having a first and and a second end, said first end being connected to said second mallet; and a third pedal adjacent to said second pedal so that said second and said third pedals are capable of being alternately actuated independently and simultaneously by the foot of an operator, said third pedal being connected to said second end of said connecting bar for imparting rotation to said connecting bar for engaging said second mallet with said drum.

22. The apparatus according to claim 21 further including a fourth pedal for operating a second pair of cymbals.

23. The apparatus according to claim 22, wherein said fourth pedal is adjacent to said first pedal so that said first and said fourth pedals are capable of being alternately actuated independently and simultaneously by the other foot of the operator.

24. The apparatus according to claim 21 further including:

a third mallet; and a fourth pedal connected to said third mallet for engaging said third mallet with a second drum, said fourth pedal being connected to the second end of said second connecting bar for imparting rotation to said connecting bar for engaging said third mallet with said second drum.

25. The apparatus according to claim 24, further including a second connecting bar having a first end and a second end, said first end of said second connecting bar being connected to said third mallet, and said fourth pedal being connected to the second end of said second connecting bar for imparting rotation to said connecting bar for engaging said third mallet with said second drum.

26. The apparatus according to claim 21 further including:

a quick release assembly for connecting said first end of said connecting bar to said second mallet so that said connecting bar may be rapidly engaged and disengaged, respectively, with said second mallet.

27. The apparatus according to claim 26 wherein said second mallet includes a base and said first end of said connecting bar is connected to said base of said second mallet.

* * * * *